US008497234B2

(12) United States Patent
Mayer et al.

(10) Patent No.: US 8,497,234 B2
(45) Date of Patent: Jul. 30, 2013

(54) SOLID TEXTILE CARE COMPOSITION COMPRISING A WATER-SOLUBLE POLYMER

(75) Inventors: Konstanze Mayer, Duesseldorf (DE); Karl-Heinz Scheffler, Duesseldorf (DE); Rene-Andres Artiga-Gonzalez, Duesseldorf (DE); Hubert Harth, Hilden (DE); Mario Sturm, Leverkusen (DE); Tobias Segler, Duesseldorf (DE); Daniel Tigges, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 278 days.

(21) Appl. No.: 12/246,129

(22) Filed: Oct. 6, 2008

(65) Prior Publication Data

US 2009/0042766 A1 Feb. 12, 2009

Related U.S. Application Data

(63) Continuation of application No. PCT/EP2007/052129, filed on Mar. 7, 2007.

(30) Foreign Application Priority Data

Apr. 6, 2006 (DE) ..... 10 2006 016 578

(51) Int. Cl.
*C11D 3/39* (2006.01)
*C11D 3/40* (2006.01)
*C11D 3/50* (2006.01)

(52) U.S. Cl.
USPC ..... 510/349; 510/515; 510/513; 510/528; 510/516; 510/517; 510/441; 510/442; 8/137; 512/4; 427/212

(58) Field of Classification Search
USPC ..... 510/515, 349, 441, 492; 8/115.51
See application file for complete search history.

(56) References Cited

U.S. PATENT DOCUMENTS

| | | | | |
|---|---|---|---|---|
| 4,134,838 | A * | 1/1979 | Hooper et al. | 510/518 |
| 5,234,649 | A * | 8/1993 | Cloeren | 264/173.16 |
| 5,246,603 | A * | 9/1993 | Tsaur et al. | 510/519 |
| 6,025,319 | A * | 2/2000 | Surutzidis et al. | 510/441 |
| 6,329,335 | B1 * | 12/2001 | Feist et al. | 510/446 |
| 2002/0119903 | A1 * | 8/2002 | Lant et al. | 510/445 |
| 2003/0139312 | A1 * | 7/2003 | Caswell et al. | 510/320 |
| 2003/0220220 | A1 * | 11/2003 | Bach et al. | 510/444 |
| 2004/0005994 | A1 | 1/2004 | Eskuchen et al. | |
| 2005/0009715 | A1 * | 1/2005 | Marin et al. | 510/101 |
| 2005/0130874 | A1 * | 6/2005 | Demeyere et al. | 510/522 |
| 2006/0094097 | A1 * | 5/2006 | Becker et al. | 435/182 |
| 2009/0082244 | A1 * | 3/2009 | Mayer et al. | 510/334 |
| 2009/0099055 | A1 * | 4/2009 | Mayer et al. | 510/334 |

FOREIGN PATENT DOCUMENTS

| | | | |
|---|---|---|---|
| EP | 1 348 756 | B1 | 3/2003 |
| WO | WO 02/44310 | A2 | 6/2002 |
| WO | WO 2005/005591 | A1 | 1/2005 |
| WO | WO 2005005591 | A1 * | 1/2005 |
| WO | WO 2005/075620 | A1 | 8/2005 |

OTHER PUBLICATIONS

International Search Report of PCT/EP2007/052129, dated Jul. 16, 2007.

* cited by examiner

*Primary Examiner* — Harold Y Pyon
*Assistant Examiner* — Katie L Hammer
(74) *Attorney, Agent, or Firm* — RatnerPrestia

(57) ABSTRACT

A solid textile care composition having a water-soluble carrier, a water-soluble polymer, a textile care compound and a perfume. A solid textile care composition in which the water-soluble carrier is present in particulate form and has an envelope composed of the water-soluble polymer, the textile care compound and the perfume. Also textile care washing or cleaning compositions comprising the textile care composition.

20 Claims, No Drawings

SOLID TEXTILE CARE COMPOSITION COMPRISING A WATER-SOLUBLE POLYMER

CROSS REFERENCE TO RELATED APPLICATIONS

This application is a continuation under 35 U.S.C. §§120 and 365(c) of International Application PCT/EP2007/052129, filed on Mar. 7, 2007. This application also claims priority under 35 U.S.C. §119 of DE 10 2006 016 578.0, filed Apr. 6, 2006. The disclosures of PCT/EP2007/052129 and DE 10 2006 016 578.0 are hereby incorporated by reference in their entirety.

BACKGROUND OF THE INVENTION

The invention relates to a solid textile care composition and the use and production thereof. In addition, the invention relates to a detergent or cleaning agent containing the solid textile care composition.

Due to repeated washing, textiles often become hard and lose their softness. To restore their softness/flexibility to textiles, to impart a pleasant scent to them and/or to improve their antistatic properties, after the actual laundering and cleaning process, the textiles are treated with a fabric softener in a subsequent rinsing operation.

Most fabric softeners on the market are aqueous formulations contain as the main active ingredient a cationic textile-softening compound having one or two long-chain alkyl groups in one molecule. Widely used cationic textile-softening compounds comprise, for example, methyl-N-(2-hydroxyethyl)-N,N-di(tallow acyloxyethyl)ammonium compounds, methyl-N-(2-hydroxyethyl)-N,N-di(tallow acyloxyethyl)ammonium compounds or N,N-dimethyl-N,N-di(tallow acyloxyethyl)ammonium compounds.

Because of the cationic textile-softening compounds, these traditional fabric softener formulations cannot be used simultaneously with the detergent or cleaning agent in the actual detergent or cleaning operating, since the cationic textile-softening compounds enter into unwanted interactions with the anionic surfactants of the detergents or cleaning agents. Therefore, an additional rinsing operation is required, but this is time consuming and energy intensive.

Another disadvantage is that traditional fabric softeners do not prevent the deposition of lime residues on the laundry during the rinsing operation. Furthermore, the traditional water softeners often leave an unattractive deposit in the rinse dispenser compartment of the washing machine.

Problems may also occur with other textile care compounds, necessitating separate dosing and/or a separate rinse cycle, for example.

DESCRIPTION OF THE INVENTION

Therefore, one object of the present invention is to provide a textile care composition which may be used in the main wash cycle together with detergents or cleaning agents.

This object is achieved by a solid textile care composition, comprising a water-soluble carrier, a water-soluble polymer, a textile care compound and a perfume.

With such a textile care composition, incompatible elements can be separated.

In addition, it is advantageous that the textile care compound and the perfume are already transported to the laundry directly at the start of the washing operation and can thus manifest their full potential. In addition, this solid composition is easier and better to handle than liquid compositions because no droplets remain behind on the edge of the bottle, which may lead to rings on the substrate in the subsequent storage of the bottle or to unattractive deposits in the area of the closure. The same thing is also true of the case when some of the composition is inadvertently spilled during dosing. The spilled composition can also be removed more easily and cleanly.

It is preferable for the water-soluble carrier to be selected from the group comprising inorganic alkali metal salts, organic alkali metal salts, inorganic alkaline earth metal salts, organic alkaline earth metal salts, organic acids, carbohydrates, silicates, urea and mixtures thereof.

These materials are not only inexpensive but also dissolve very well in water. Furthermore these materials have a neutral odor.

It is advantageous that the solid textile care composition contains 50 wt % to 99 wt %, preferably 75 wt % to 95 wt % of the water-soluble carrier.

In addition, it is preferable for the textile care compound to be selected from textile softening compounds, bleaching agents, bleach activators, enzymes, silicone oils, antiredeposition agents, optical brighteners, graying inhibitors, shrinkage inhibitors, crease-preventing agents, dye-transfer inhibitors, antimicrobial active ingredients, germicides, fungicides, antioxidants, antistatics, ironing aids, phobicizing agents and impregnation agents, swelling agents and anti-slip agents, UV absorbers and mixtures thereof.

It is preferable in particular for the textile care compound to be a textile-softening compound. It is most especially preferable for the textile-softening compound to be selected from polysiloxanes, textile-softening clays, cationic polymers and mixtures thereof.

Such a fabric softener can be used in the main wash cycle of an automatic washing or cleaning process. The textile care composition may be added to the drum or to the rinse dispenser compartment of a washing machine together with the detergent or cleaning agent. This has the advantage that no additional rinse cycle is necessary and there are no unattractive deposits in the rinse dispenser compartment.

The use of polysiloxanes and/or cationic polymers as textile care compounds in the textile care composition is advantageous because these have not only a softening effect but also increase the perfume impression on the laundry. The use of softening clays as textile care compounds in the textile care composition is advantageous because they additionally have a water softening effect and can thus prevent lime deposits on the laundry. To achieve an optimum effect, it may be preferable for a textile care composition to contain a combination of at least two textile care compounds.

It is preferable for the water-soluble polymer to have a melting point or softening point in the range of 48° C. to 300° C., preferably in the range of 48° C. to 100° C. In addition, it is preferable for the water-soluble polymer to be selected from polyalkylene glycols, polyethylene terephthalates, polyvinyl alcohols and mixtures thereof. These water-soluble polymers function as binders.

In a preferred embodiment, the textile care composition contains 0.1 to 20 wt %, preferably 1 to 10 wt % and particularly preferably 2 to 7 wt % perfume.

With traditional liquid fabric softener compositions comprising quaternary ammonium compound as textile care compounds, a problem occurs with the stability of the composition at higher perfume concentrations (>0.4 wt % perfume with regular fabric softener compositions and ≧1 wt % with concentrated fabric softener compositions). With the inventive textile care compositions, larger quantities (≧1 wt %) of perfume may be incorporated with no problem.

It is preferable in particular for the water-soluble carrier to be in particulate form and to have at least partially a sheathing of the water-soluble polymer, the textile care compound and the perfume.

In an alternative but also particularly preferred embodiment, the water-soluble carrier is in particulate form and is coated with the textile care compound. In addition, the coated water-soluble carrier has at least partially a sheathing of the water-soluble polymer and the perfume.

In this way, different textile care compositions can be obtained easily and quickly because only the composition of the sheathing need be altered, for example.

In another alternative embodiment, the water-soluble carrier is in particulate form and has an at least partial sheathing of the water-soluble polymer and the perfume, wherein the sheathing or the sheathing and the unsheathed areas of the water-soluble carrier are at least partially coated with the textile care compound.

In all three embodiments, it is preferred in particular for the water-soluble carrier to have particle sizes in the range of 0.6 mm to 30 mm, in particular 0.8 mm to 7 mm, and especially preferably 1 mm to 3 mm.

Textile care compositions having particle sizes in the range of 0.8 mm to 7 mm and especially preferably in the range of 1 mm to 3 mm can be dosed especially well and in a targeted manner.

To improve the technical use properties and/or aesthetic properties of the textile care composition, it may be additionally contain ingredients, preferably selected from the group comprising dyes, perfume, fillers, pearlizing agents, skin care compounds and mixtures thereof.

The invention also relates to the use of an inventive solid textile care composition for conditioning textile fabrics.

In addition, the invention relates to a method for producing a solid textile care composition comprising a particular water-soluble carrier, a water-soluble polymer, a textile care compound and a perfume, whereby the water-soluble polymer is melted, then mixed in the molten state with the textile care compound and the perfume and then added to the particulate carrier, so that the latter is at least partially sheathed with it.

The invention also relates to a method for producing a solid textile care composition comprising a particulate water-soluble carrier, a water-soluble polymer, a textile care compound and a perfume with which the water-soluble carrier is coated with the textile care compound, the water-soluble polymer is melted, then mixed in the molten state with the perfume and the resulting melt is applied to the coated particulate carrier in such way that the latter is at least partially sheathed.

Furthermore, the invention relates to a method for producing a solid textile care composition comprising a particulate water-soluble carrier, a water-soluble polymer, a textile care compound and a perfume with which the water-soluble polymer is melted, mixed with the perfume in the molten state, the resulting melt is applied to the particulate carrier in such a way that it is at least partially sheathed and the at least partially sheathed particulate carrier is coated with the textile care compound.

Furthermore, the invention relates to a detergent or cleaning agent comprising an inventive solid textile care composition.

By introducing the inventive textile care composition into a detergent or cleaning agent, the user has access to a textile care detergent or cleaning agent (2-in-1 detergent or cleaning agent) and need not dose two agents. The user thus has access to a textile-softening detergent or cleaning agent (2-in-1 detergent or cleaning agent) when a textile-softening composition is added to a detergent or cleaning agent and then need not dose two agents (detergent or cleaning agent and fabric softener) and need not have a separate rinse cycle.

In addition, the detergent or cleaning agent and the textile care composition need not be perfumed; instead only one of the two agents, preferably the textile care composition need be perfumed. This not only leads to lower costs but is also advantageous for consumers with sensitive skin and/or allergies.

The invention is described in greater detail below on the basis of examples, among other things.

The solid textile care composition contains as essential ingredients a water-soluble carrier, a water-soluble polymer, a textile care compound and a perfume.

An essential ingredient of the textile care composition is the water-soluble carrier. This comprises preferably inorganic alkali metal salts, e.g., sodium chloride, potassium chloride, sodium sulfate, sodium carbonate, potassium sulfate, potassium carbonate, sodium bicarbonate, potassium bicarbonate or mixtures thereof, organic alkali metal salts, such as sodium acetate, potassium acetate, sodium citrate, sodium tartrate or potassium sodium tartrate, inorganic alkaline earth metal salts, such as calcium chloride or magnesium chloride, organic alkaline earth metal salts, such as calcium lactate, carbohydrates, organic acids such as citric acid or tartaric acid, silicates such as water glass, sodium silicate or potassium silicate, urea and mixtures thereof. The water-soluble carrier may comprise in particular a carbohydrate selected from the group comprising dextrose, fructose, galactose, isoglucose, glucose, sucrose, raffinose, isomalt and mixtures thereof. The carbohydrate used may be, for example, candied sugar or sugar crystals.

The water-soluble carrier may also comprise mixtures of the aforementioned materials.

It is preferable for the water-soluble carrier to be particulate and to have particle sizes in the range of 0.6 mm to 30 mm, in particular 0.8 mm to 7 mm and especially 1 mm to 3 mm.

A textile care compound in this context is understood to be any compound which imparts to textile fabrics treated with it an advantageous effect such as a textile-softening effect, a crease-resistant effect and/or reduces the harmful or negative effects that may occur in cleaning and/or conditioning and/or wearing, e.g., fading, graying, etc.

The textile care compound may comprise, for example, a textile-softening compound, bleaching agents, bleach activators, enzymes, silicone oils, antiredeposition agents, optical brighteners, graying inhibitors, shrinkage inhibitors, crease-preventing agents, dye-transfer inhibitors, antimicrobial active ingredients, germicides, fungicides, antioxidants, antistatics, ironing aids, phobicizing agents and impregnation agents, swelling agents and anti-slip agents, UV absorbers and mixtures thereof. Specific examples of these textile care compounds can be found in the description of the inventive detergent or cleaning agent and may also be used in the solid textile care composition.

The textile care compound is preferably a textile-softening compound and is, for example, a polysiloxane, a textile-softening clay, a cationic polymer or a mixture of at least two of these textile care compounds. Accordingly, the textile care composition is preferably a textile-softening composition.

A preferred polysiloxane that may be used here has at least the following structural unit:

a)

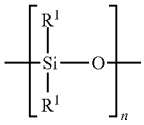

wherein $R^1$=independently of one another, $C_1$-$C_{30}$ alkyl, preferably $C_1$-$C_4$ alkyl, in particular methyl or ethyl, n=1 to 5000, preferably 10 to 2500, in particular 100 to 1500.

It may be preferable for the polysiloxane to also have the following structural unit:

b)

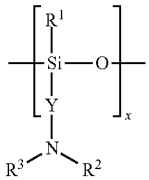

wherein $R^1$=$C_1$-$C_{30}$ alkyl, preferably $C_1$-$C_4$ alkyl, in particular methyl or ethyl, Y=optionally substituted, linear or branched $C_1$-$C_{20}$ alkylene, preferably —$(CH_2)_m$—, where m=1 to 16, preferably 1 to 8, in particular 2 to 4, specifically 3, $R^2$, $R^3$=independently of one another, H or optionally substituted linear or branched $C_1$-$C_{30}$ alkyl or $C_1$-$C_{30}$ alkyl preferably substituted with amino groups, especially preferably —$(CH_2)_b$—$NH_2$ with b=1 to 10, extremely preferably b=2, x=1 to 5000, preferably 10 to 2500, in particular 100 to 1500.

If the polysiloxane has only structural unit a) with $R^1$=methyl, then it is a polydimethylsiloxane. Polydimethylpolysiloxanes are known to be efficient textile care compounds.

Suitable polydimethylsiloxanes include DC-200 (from Dow Corning), Baysilone® M 50, Baysilone® M 100, Baysilone® M 350, Baysilone® M 500, Baysilone® M 1000, Baysilone® M 1500, Baysilone® M 2000 or Baysilone® M 5000 (all from GE Bayer Silicones).

However, it may also be preferable for the polysiloxane to contain structural units a) and b). An especially preferred polysiloxane has the following structure:

$$(CH_3)_3Si—[O—Si(CH_3)_2]_n—[O—Si(CH_3)\{(CH_2)_3—NH—(CH_2)_2—NH_2\}]_x—OSi(CH_3)_3$$

where the sum of n+x is a number between 2 and 10,000.

Suitable polysiloxanes having structural units a) and b) are available commercially under the brand names DC2-8663, DC2-8035, DC2-8203, DC05-7022 or DC2-8566 (all from Dow Corning), for example. Also suitable according to the present invention are the commercially available products Dow Corning® 7224, Dow Corning® 929 Cationic Emulsion or Formasil 410 (GE Silicones), for example.

A suitable textile-softening clay is, for example, a smectite clay. Preferred smectite clays include beidellite clays, hectorite clays, laponite clays, montmorillonite clays, nontronite clays, saponite clays, sauconite clays and mixtures thereof. Montmorillonite clays are the most preferred softening clays. Bentonites contain mainly montmorillonites and they serve as preferred source for the textile-softening clay. The bentonites may be used as a powder or crystals.

Suitable bentonites are distributed under the brand names Laundrosil® from the company Süd-Chemie or under the trademark Detercal by the company Laviosa, for example.

Suitable cationic polymers include in particular those described in "CTFA International Cosmetic Industry Dictionary," Fourth edition, J. M. Nikitakis et al., editors, published by the Cosmetic, Toiletry and Fragrance Association, 1991 and summarized under the collective term "polyquaternium." A few suitable polyquaternium compounds are listed specifically below.

POLYQUATERNIUM-1 (CAS number 68518-54-7)

Definition:

$\{(HOCH_2CH_2)_3N^+—CH_2CH=CHCH_2—[N^+(CH_3)_2—CH_2CH=CHCH_2]_x—N^+(CH_2CH_2OH)_3\}[Cl^-]_{x+2}$

POLYQUATERNIUM-2 (CAS number 63451-27-4)

Definition:

$[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$

Obtainable as Mirapol® A-15 (from Rhodia), for example

POLYQUATERNIUM-3

Definition: Copolymer of acrylamide and trimethylammonium ethyl methacrylate methosulfate POLYQUATERNIUM-4 (CAS number 92183-41-0)

Definition: Copolymer of hydroxyethyl cellulose and diallyldimethylammonium chloride Obtainable as Celquat® H 100 or Celquat® L200 (from National Starch), for example POLYQUATERNIUM-5 (CAS number 26006-22-4)

Definition: Copolymer of acrylamide and β-methacrylyloxyethyltrimethyl-ammonium methosulfate Obtainable as Nalco 7113 (from Nalco) or Reten® 210, Reten® 220, Reten® 230, Reten® 240, Reten® 1104, Reten® 1105 or Reten® 1106 (all from Hercules), for example POLYQUATERNIUM-6 (CAS number 26062-79-3)

Definition: Polymer of dimethyldiallylammonium chloride

Obtainable as Merquat® 100 (from Ondeo-Nalco), for example

POLYQUATERNIUM-7 (CAS number 26590-05-6)

Definition: Polymeric quaternary ammonium salt comprising acrylamide and dimethyldiallylammonium chloride monomers Obtainable as Merquat® 550 or Merquat® S (from Ondeo-Nalco), for example

POLYQUATERNIUM-8

Definition: Polymeric quaternary ammonium salt of methyl- and stearyldimethyl-aminoethyl methacrylate quaternated with dimethyl sulfate

POLYQUATERNIUM-9

Definition: Polymeric quaternary ammonium salt of polydimethylaminoethyl methacrylate quaternated with methyl bromide POLYQUATERNIUM-10 (CAS numbers 53568-66-4; 55353-19-0; 54351-50-7; 81859-24-7; 68610-92-4; 81859-24-7)

Definition: Polymeric quaternary ammonium salt of hydroxyethyl cellulose reacted with a trimethylammonium-substituted epoxy Obtainable as Celquat® SC-240 (from National Starch), UCARE® Polymer JR-125, UCARE® Polymer JR-400, UCARE® Polymer JR-30M, UCARE® Polymer LR 400, UCARE® Polymer LR 30M, UCARE® Polymer SR-10 (all from Amerchol), for example POLYQUATERNIUM-11 (CAS number 53633-54-8)
Definition: Quaternary ammonium polymer formed by reaction of diethyl sulfate with the copolymer of vinylpyrrolidone and dimethylaminoethyl methacrylate.
Obtainable as Luviquat® PQ 11 PN (from BASF), Gafquat® 734, Gafquat® 755 or Gafquat® 755N (from GAF), for example POLYQUATERNIUM-12 (CAS number 68877-50-9)
Definition: Quaternary ammonium polymer salt formed by reaction of ethyl methacrylate/abietyl methacrylate/diethylaminoethyl methacrylate copolymer with dimethyl sulfate POLYQUATERNIUM-13 (CAS number 68877-47-4)
Definition: Polymeric quaternary ammonium salt obtainable by reaction of ethyl methacrylate/oleyl methacrylate/diethylaminoethyl methacrylate copolymer with dimethyl sulfate POLYQUATERNIUM-14 (CAS number 27103-90-8)
Definition: Polymeric quaternary ammonium salt of the formula $—\{—CH_2—C—(CH_3)—[C(O)O—CH_2CH_2—N(CH_3)_3]\}_x^+[CH_3SO_4]_x^-$ POLYQUATERNIUM-15 (CAS number 35429-19-7)
Definition: Copolymer of acrylamide and β-methacrylyloxyethyltrimethyl-ammonium chloride POLYQUATERNIUM-16 (CAS number 95144-24-4)
Definition: Polymeric quaternary ammonium salt formed from methylvinyl-imidazolium chloride and vinylpyrrolidone
Obtainable as Luviquat® FC 370, Luviquat® Style, Luviquat® FC 550 or Luviquat® Excellence (all from BASF), for example POLYQUATERNIUM-17 (CAS number 90624-75-2)
Definition: Polymeric quaternary ammonium salt obtainable by reaction of adipic acid and dimethylaminopropylamine with dichloroethyl ether
Obtainable as Mirapol® AD-1 (from Rhodia), for example POLYQUATERNIUM-18
Definition: Polymeric quaternary ammonium salt obtainable by reaction of azelaic acid and dimethylaminopropylamine with dichloroethyl ether
Obtainable as Mirapol® AZ-1 (from Rhodia), for example POLYQUATERNIUM-19
Definition: Polymeric quaternary ammonium salt obtainable by reaction of polyvinyl alcohol with 2,3-epoxypropylamine POLYQUATERNIUM-20
Definition: Polymeric quaternary ammonium salt obtainable by reaction of polyvinyloctadecyl ether with 2,3-epoxypropylamine POLYQUATERNIUM-21 (CAS number 102523-94-4)
Definition: Polysiloxane/polydimethyldialkylammonium acetate copolymer
Obtainable as Abil® B 9905 (from Goldschmidt-Degussa), for example POLYQUATERNIUM-22 (CAS number 53694-17-0)
Definition: Dimethyldiallylammonium chloride/acrylic acid copolymer
Obtainable as Merquat® 280 (from Ondeo-Nalco), for example POLYQUATERNIUM-24 (CAS number 107987-23-5)
Definition: Polymeric quaternary ammonium salt from the reaction of hydroxyethyl cellulose with a lauryl dimethylammonium-substituted epoxide
Obtainable as Quatrisolft® Polymer LM 200 (from Amerchol), for example POLYQUATERNIUM-27
Definition: Block copolymer from the reaction of polyquaternium-2 with polyquaternium-17

POLYQUATERNIUM-28 (CAS number 131954-48-8)
Definition: Vinylpyrrolidone/methacrylamidopropyltrimethylammonium chloride copolymer
Obtainable as Gafquat® HS-100 (from GAF), for example POLYQUATERNIUM-29
Definition: Chitosan reacted with propylene oxide and quaternated with epichlorohydrin POLYQUATERNIUM-30
Definition: Polymeric quaternary ammonium salt of the formula $—[CH_2C(CH_3)(C(O)OCH_3)]_x[CH_2C(CH_3)(C(O)OCH_2CH_2N^+(CH_3)_2CH_2COO^-)]_y—$ POLYQUATERNIUM-31 (CAS number 136505-02-7)

POLYQUATERNIUM-32 (CAS number 35429-19-7)
Definition: Polymer of N,N,N-trimethyl-2-[(2-methyl-1-oxo-2-propenyl)oxy]-ethaneaminium chloride with 2-propeneamide POLYQUATERNIUM-37 (CAS number 26161-33-1)
Definition: Homopolymer of methacryloyltrimethyl chloride
Obtainable as Synthalen® CR (from 3V Sigma), for example POLYQUATERNIUM-44 (CAS number 150595-70-5)
Definition: Quaternary ammonium salt of the copolymer of vinylpyrrolidone and quaternated imidazoline
Obtainable as Luviquat® Ultracare (from BASF), for example POLYQUATERNIUM-68 (CAS number 827346-45-2)
Definition: Quaternated copolymer of vinylpyrrolidone, methacrylamide, vinylimidazole and quaternated vinylimidazole
Obtainable as Luviquat® Supreme (from BASF), for example It may be preferable for the textile care composition to contain a textile-softening compound and one or more additional textile care compound(s).

The amount of textile care compound in the textile care composition is 0.1 wt % to 15 wt % and preferably between 2 wt % and 12 wt %.

Another ingredient of the textile care composition is the water-soluble polymer. Suitable water-soluble polymers preferably have a melting point or softening point in the range of 48° C. to 300° C. and may include in particular polyethylene glycols, polyethylene terephthalates and/or polyvinyl alcohols. It is preferable in particular for the water-soluble polymers to have a melting point or softening point in the range of 48° C. to 100° C.

The melting point refers to the transition from a solid state to a liquid (free-flowing) state. The softening temperature describes the transition from a solid state to a rubbery to viscous melt. The melting point and softening point may each be either a certain temperature or a small range within the range of 48° C. to 300° C.

Suitable polyalkylene glycols include in particular polyethylene glycols which are liquid or solid polymers, depending on chain length. Above a molecular weight of 3000, polyethylene glycols are solid substances and are brought on the market in the form of flakes or powder. Hardness and melting range increase with increasing molecular weight. Polyethylene glycols with an average molecular weight between 3000 and 10,000 are preferred in particular for the present invention.

Polyethylene terephthalate is a polyester which is commercially available in crystalline form (opaque white) as well as in amorphous form (transparent), for example. The melting point of crystalline polyethylene terephthalate is approx. 260° C. As thermoplastics, polyethylene terephthalates can be shaped with heat into virtually any desired form. Furthermore, modified polyethylene terephthalates (for example, blends with other polymers or polyethylene terephthalates with foreign building blocks incorporated) may also be used.

Polyvinyl alcohols are available commercially as a yellowish white powder or granules having degrees of polymerization in the range of approx. 500-2500 (molecular weights of approx. 20,000 g/mol to 100,000 g/mol). The degree of hydrolysis is 98-99 mol % or 87-89 mol % and thus the polyvinyl alcohols still have a residual acetyl group content. The polyvinyl alcohols are characterized by manufacturers by giving the degree of polymerization of the starting polymer, the degree of hydrolysis and/or the saponification number. Fully saponified polyvinyl alcohols have a softening temperature of 85° C. and a melting point of 228° C. The corresponding values for partially saponified (87-89%) products are much lower with approx. 58° C. (softening point) and/or 186° C. (melting point), respectively.

The water-soluble polymer may also contain a mixture of the aforementioned materials.

Another essential ingredient of the textile care composition is the perfume. Perfume oils and/or scents that may be used include individual perfume compounds, e.g., the synthetic products of the type of esters, ethers, aldehydes, ketones, alcohols and hydrocarbons. However, mixtures of different perfumes which jointly produce an appealing scent note are preferably used. Such perfume oils may also contain natural perfume mixtures such as those available from plant sources.

The amount of perfume in the textile care composition is preferably between 0.1 wt % and 15 wt %, in particular preferably between 3 wt % and 10 wt % and most especially preferably between 5 wt % and 8 wt %.

The textile care composition may optionally contain additional ingredients.

To improve the aesthetic impression of the textile care compound, they may be pigmented with suitable pigments. Preferred dyes, the selection of which does not pose any problems for those skilled in the art, have a high stability in storage and are insensitive to the other ingredients of the detergents or cleaning agents and are insensitive to light and do not have a pronounced substantivity with respect to textile fibers so as not to stain them.

In addition, the textile care composition may contain a filler such as silica. The amount of filler may be between 0.1 wt % and 10 wt % and is preferably 1 wt % to 5 wt %.

The textile care composition may also contain a pearlizing agent to increase the gloss. Examples of suitable pearlizing agents include ethylene glycol mono- and distearate (e.g., Cutina® AGS from Cognis) and PEG-3 distearate.

In addition, the textile care composition may also comprise a skin care compound.

A skin care compound is understood to be a compound or a mixture of compounds which are absorbed onto the textile when the textile comes in contact with the detergent and impart an advantage to the skin when the textile comes in contact with the skin in comparison with a textile not treated with the inventive detergent and cleaning agent. This advantage may include, for example, the transfer of the skin care compound from the textile to the skin, less transfer of water from the skin to the textile or less friction of the textile against the skin surface.

The skin care compound is preferably hydrophobic, may be liquid or solid and must be compatible with the other ingredients of the solid textile care composition. The skin care compound may be, for example a) waxes such as carnauba, spermaceti, beeswax, lanolin, derivatives thereof and mixtures thereof;

b) plant extracts, e.g., vegetable oils such as avocado oil, olive oil, palm oil, palm kernel oil, rapeseed oil, linseed oil, soybean oil, peanut oil, coriander oil, castor oil, poppyseed oil, cocoa oil, coconut oil, pumpkin seed oil, wheat germ oil, sesame oil, sunflower oil, almond oil, macadamia nut oil, apricot kernel oil, hazelnut oil, jojoba oil or canola oil, chamomile, aloe vera and mixtures thereof;

c) higher fatty acids such as lauric acid, myristic acid, palmitic acid, stearic acid, behenic acid, oleic acid, linoleic acid, linolenic acid, isostearic acid or polyunsaturated fatty acids;

d) higher fatty alcohols such as lauryl alcohol, cetyl alcohol, stearyl alcohol, oleyl alcohol, behenyl alcohol or 2-hexadecanol;

e) esters such as cetyl octanoate, lauryl lactate, myristyl lactate, cetyl lactate, isopropyl myristate, myristyl myristate, isopropyl palmitate, isopropyl adipate, butyl stearate, decyl, oleate, cholesterol isostearate, glycerol monostearate, glycerol distearate, glycerol tristearate, alkyl lactate, alkyl citrate of alkyl tartrate;

f) hydrocarbons such as paraffins, mineral oils, squalane or squalene;

g) lipids;

h) vitamins such as vitamin A, C or E or vitamin alkyl esters;

i) phospholipids;

j) sunscreen agents such as octyl methoxycinnamate and butyl methoxybenzoylmethane;

k) silicone oils such as linear or cyclic polydimethylsiloxanes, amino-substituted, alkyl-substituted, alkylaryl-substituted or aryl-substituted silicone oils and l) mixtures thereof.

The amount of skin care compound is preferably between 0.01 wt % and 10 wt %, preferably between 0.1 wt % and 5 wt % and most especially preferably between 0.3 wt % and 3 wt %, based on the solid textile care composition. The skin care compound may additionally also have a textile care effect.

In a most especially preferred embodiment, the water-soluble carrier is particulate and is at least partially sheathed with a mixture of the water-soluble polymer, the textile care compound, the perfume and optionally the additionally ingredients.

To produce such a solid textile care composition, the water-soluble polymer is first melted and is mixed in the molten state with the textile care compound, the perfume and optionally the additional ingredients. Then the melt is applied to the particulate carrier in such a way that the latter is at least partially sheathed with the melt.

In another especially preferred embodiment, the water-soluble carrier is particulate, is coated with the textile care compound and is at least partially sheathed with a mixture of the water-soluble polymer, the perfume and optionally the additional ingredients.

To produce such a solid textile care composition, first the particulate carrier is mixed with the textile care compound. In the next step, the water-soluble polymer is melted, mixed in the molten state with the perfume and optionally the additional ingredients and then the melt is applied to the particulate carrier coated with the textile care compound in such a way that the carrier is at least partially sheathed.

In yet another preferred embodiment, the water-soluble carrier is present in particulate form and has at least partial sheathing of the water-soluble polymer and the perfume, where the sheathing or the sheathing and the unsheathed areas of the water-soluble carrier are at least partially coated with the textile care compound.

To produce such a solid textile care composition, first the water-soluble polymer is melted and in the melted stated is mixed with the perfume. The resulting melt is then applied to the particulate carrier so that the latter is at least partially sheathed and then the at least partially sheathed particulate carrier is coated with the textile care compound.

The textile care composition is suitable in particular for conditioning textile fabrics, and to do so, is brought into contact with the textile fabric using a traditional detergent or cleaning agent in the (main) wash cycle of a traditional washing and cleaning process.

The textile care composition may be introduced into a detergent or cleaning agent.

To do so, a solid detergent or cleaning agent is mixed with 0.1 wt % to 20 wt %, preferably 1 wt % to 10 wt % of the inventive textile care composition.

The inventive textile care detergents or cleaning agents contain, in addition to the textile care composition, surfactant(s), whereby anionic, nonionic, zwitterionic and/or amphoteric surfactants may be used. From the standpoint of applications technology, mixtures of anionic and nonionic surfactants are preferred. The total surfactant content of a detergent is preferably less than 40 wt % and especially preferably less than 35 wt %, based on the total liquid detergent.

Preferably alkoxylated, advantageously ethoxylated, in particular primary alcohols with preferably 8 to 18 carbon atoms and an average of 1 to 12 mol ethylene oxide (EO) per mol alcohol are used as the nonionic surfactants, in which the alcohol radical may be linear or preferably methyl-branched in position 2 and/or may contain linear and methyl-branched radicals in mixture, as they usually occur in oxo alcohol radicals. In particular, however, alcohol ethoxylates having linear radicals of alcohols of a native origin with 12 to 18 carbon atoms, e.g., from coconut, palm, tallow fatty alcohol or oleyl alcohol and an average 2 to 8 EO per mol alcohol, are preferred. The preferred ethoxylated alcohols include, for example, $C_{12-14}$ alcohols with 3 EO, 4 EO or 7 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 7 EO. The stated degrees of ethoxylation are statistical averages, which may be an integer or a fraction for a specific product. Preferred alcohol ethoxylates have a narrow homolog distribution (narrow range ethoxylates, NRE). In addition to these nonionic surfactants, fatty alcohols having more than 12 EO may also be used. Examples include tallow fatty alcohol with 14 EO, 25 EO, 30 EO or 40 EO. Nonionic surfactants containing EO and PO groups together in the molecule may also be used according to the invention. Block copolymers with EO-PO block units and/or PO-EO block units may be used here, but EO-PO-EO copolymers and/or PO-EO-PO copolymers may also be used. Mixed alkoxylated nonionic surfactants, in which EO and PO units do not occur in blocks but instead are randomly distributed, may of course also be used. Such products are accessible by simultaneous action of ethylene oxide and propylene oxide on fatty alcohols.

Furthermore, as additional nonionic surfactants, alkyl glycosides of the general formula $RO(G)_x$ may also be used, in which R denotes a primary linear or methyl-branched aliphatic radical, in particular with methyl branching in position 2, with 8 to 22 carbon atoms, preferably 12 to 18 carbon atoms, and G is the symbol standing for a glycose unit with 5 or 6 carbon atoms, preferably glucose. The degree of oligomerization x, which indicates the distribution of monoglycosides and oligoglycosides, is any number between 1 and 10; x is preferably 1.2 to 1.4. Alkyl glycosides are known mild surfactants.

Another class of nonionic surfactants that are preferably used, either as the exclusive nonionic surfactant or in combination with other nonionic surfactants, include alkoxylated, preferably ethoxylated or ethoxylated and propoxylated fatty acid alkyl esters, preferably with 1 to 4 carbon atoms in the alkyl chain, in particular fatty acid methyl esters.

Nonionic surfactants of the amine oxide type, e.g., N-cocoalkyl-N,N-dimethylamine oxide and N-tallow alkyl-N,N-dihydroxyethylamine oxide and the fatty acid alkanolamides may also be suitable. The amount of these nonionic surfactants is preferably no more than that of the ethoxylated fatty alcohols, in particular no more than half thereof Other suitable surfactants include polyhydroxy fatty acid amides of the formula (VII)

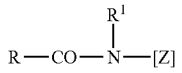

(VII)

in which RCO stands for an aliphatic acyl radical with 6 to 22 carbon atoms, $R^1$ stands for hydrogen, an alkyl or hydroxyalkyl radical with 1 to 4 carbon atoms and [Z] stands for a linear or branched hydroxy alkyl radical with 3 to 10 carbon atoms and 3 to 10 hydroxyl groups. The polyhydroxy fatty acid amides are known substances, which can usually be obtained by reductive amination of a reducing sugar with ammonia, an alkylamine or an alkanolamine and subsequent acylation with a fatty acid, a fatty acid alkyl ester or a fatty acid chloride.

The group of polyhydroxy fatty acid amides also includes compounds of formula (VIII)

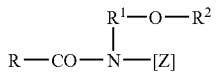

(VIII)

in which R stands for a linear or branched alkyl radical or alkenyl radical with 7 to 12 carbon atoms, $R^1$ stands for a linear, branched or cyclic alkyl radical or an aryl radical with 2 to 8 carbon atoms and $R^2$ stands for a linear, branched or cyclic alkyl radical or an aryl radical or an oxyalkyl radical with 1 to 8 carbon atoms, where $C_{1-4}$ alkyl or phenyl radicals are preferred and [Z] stands for a linear polyhydroxyalkyl radical whose alkyl chain is substituted with at least two hydroxyl groups or alkoxylated preferably ethoxylated or propoxylated derivatives of this radical.

[Z] is preferably obtained by reductive amination of a sugar, e.g., glucose, fructose, maltose, lactose, galactose, mannose or xylose. The N-alkoxy- or N-aryloxy-substituted compounds can then be converted into the desired polyhydroxy fatty acid amides by reaction with fatty acid methyl esters in the presence of an alkoxide as the catalyst.

The nonionic surfactant content in the detergents or cleaning agents is preferably 5 wt % to 30 wt %, preferably 7 wt % to 20 wt % and in particular 9 wt % to 15 wt %, each based on the total detergent or cleaning agent.

The anionic surfactants are preferably those of the sulfonate and sulfate type. Preferably $C_{9-13}$ alkylbenzene-sulfonates, olefinsulfonates, i.e., mixtures of alkene and hydroxyalkanesulfonates as well as disulfonates, such as those obtained, for example, from $C_{12-18}$ monoolefins with terminal or internal double bonds by sulfonation with gaseous sulfur trioxide and then alkaline or acid hydrolysis of the sulfonation products may be considered as surfactants of the sulfonate type. Alkanesulfonates obtained from $C_{12-18}$ alkanes by sulfochlorination, for example, or by sulfoxidation with subsequent hydrolysis and/or neutralization are also suitable. Likewise, esters of α-sulfofatty acids (ester sulfonates), e.g., α-sulfonated methyl esters of hydrogenated coconut, palm kernel or tallow fatty acids are also suitable.

Other suitable anionic surfactants include the sulfated fatty acid glycerol esters. Fatty acid glycerol esters are understood to be the monoesters, diesters and triesters as well as mixtures thereof, such as those obtained in synthesis by esterification of a monoglycerol with 1 to 3 mol fatty acid or in transesterification of triglycerides with 0.3 to 2 mol glycerol. Preferred sulfated fatty acid glycerol esters include the sulfation products of saturated fatty acids with 6 to 22 carbon atoms, e.g., caproic acid, caprylic acid, capric acid, myristic acid, lauric acid, palmitic acid, stearic acid or behenic acid.

The alkali salts and in particular the sodium salts of sulfuric acid hemiesters of $C_{12}$-$C_{18}$ fatty alcohols, e.g., of coco fatty alcohol, tallow fatty alcohol, lauryl, myristyl, cetyl or stearyl alcohol or the $C_{10}$-$C_{20}$ oxo alcohols and the hemiesters of secondary alcohols of these chain lengths are preferred as the alk(en)yl sulfates. Also preferred are the alk(en)yl sulfates of the aforementioned chain length, which contain a synthetic linear alkyl radical synthesized on a petrochemical basis and have a degradation behavior similar to that of the adequate compounds based on the raw materials of fat chemistry. Of industrial interest for detergents, $C_{12}$-$C_{16}$ alkyl sulfates and $C_{12}$-$C_{15}$ alkyl sulfates as well as $C_{14}$-$C_{15}$ alkyl sulfates are preferred. Suitable anionic surfactants also include 2,3-alkyl sulfates, which can be obtained as commercial products from Shell Oil Co. under the name DAN®.

The sulfuric acid monoesters of the linear or branched $C_{7-21}$ alcohols ethoxylated with 1 to 6 mol ethylene oxide such as 2-methyl-branched $C_{9-11}$ alcohols with an average of 3.5 mol ethylene oxide (EO) or $C_{12-18}$ fatty alcohols with 1 to 4 EO are also suitable. They are used in cleaning agents only in relatively small amounts, e.g., in amounts of 1 wt % to 5 wt %, because of their high sudsing ability.

Other suitable anionic surfactants also include the salts of alkylsulfosuccinic acid which are also known as sulfosuccinates or sulfosuccinic acid esters and the monoesters and/or diesters of sulfosuccinic acid with alcohols, preferably fatty alcohols and in particular ethoxylated fatty alcohols. Preferred sulfosuccinates contain $C_{8-18}$ fatty alcohol radicals or mixtures thereof. Preferred sulfosuccinates contain in particular a fatty alcohol radical derived from ethoxylated fatty alcohols which are nonionic surfactants when considered alone. Again sulfosuccinates whose fatty alcohols radicals are derived from ethoxylated fatty alcohols with a narrow homolog distribution are especially preferred. It is also likewise possible to use alk(en)ylsuccinic acid with preferably 8 to 18 carbon atoms in the alk(en)yl chain or the salts thereof.

Preferred anionic surfactants are in particular soaps. Saturated and unsaturated fatty acid soaps are suitable, e.g., the salts of lauric acid, myristic acid, palmitic acid, stearic acid, (hydrogenated) erucaic acid and behenic acid as well as in particular soap mixtures derived from natural fatty acids, e.g., coconut, palm kernel, olive oil or tallow fatty acids.

The anionic surfactants including the soaps may be used in the form of their sodium, potassium or ammonium salts as well as being the soluble salts of organic bases such as mono-, di- or triethanolamine. The anionic surfactants are preferably in the form of their sodium or potassium salts, in particular in the form of the sodium salts.

The anionic surfactant content of preferred detergents or cleaning agents is 2 wt % to 30 wt %, preferably 4 wt % to 25 wt % and in particular 5 wt % to 22 wt %, each based on the total detergent or cleaning agent.

In addition to the textile care composition and the surfactants, the detergents or cleaning agents may contain other ingredients which further improve the aesthetic properties of the detergents or cleaning agent or the technical properties pertaining to applications. Within the scope of the present invention, preferred detergents or cleaning agents additionally contain one or more substances from the group of builders, bleaching agents, bleach activators, enzymes, perfumes, perfume carriers, fluorescent agents, dyes, foam inhibitors, silicone oils, antiredeposition agents, optical brighteners, graying inhibitors, shrinkage inhibitors, crease-preventing agents, dye-transfer inhibitors, antimicrobial active ingredients, germicides, fungicides antioxidants, preservatives, corrosion inhibitors, antistatics, bitter agents, ironing aids, phobicizing agents and impregnating agents, swelling agents and anti-slip agents, neutral fillers and UV absorbers.

In particular silicates, aluminum silicates (in particular zeolites), carbonates, salts of organic dicarboxylic acids and polycarboxylic acids as well as mixtures of these substances may be mentioned as builders that may be present in the detergents or cleaning agents.

Suitable crystalline layer forming sodium silicates have the general formula $NaMSi_xO_{2x+1}H_2O$, where M denotes sodium or hydrogen, x is a number from 1.9 to 4 and y is a number from 0 to 20 and the preferred values for x are 2, 3 or 4. Preferred crystalline layered silicates of the stated formula are those in which M stands for sodium and x assumes the value 2 or 3. In particular both β- and δ-sodium disilicates $Na_2Si_2O_5.yH_2O$ are preferred.

Amorphous sodium silicates with an $Na_2O:SiO_2$ module of 1:2 to 1:3.3, preferably from 1:2 to 1:2.8 and in particular from 1:2 to 1:2.6 which have delayed dissolving and secondary washing properties may also be used. The dissolving delay in comparison with traditional amorphous sodium silicates may be induced in various ways, e.g., by surface treatment, compounding, compacting/compressing or by overdrying. Within the scope of this invention, the term "amorphous" is also understood to be "x-ray amorphous." This means that in x-ray diffraction experiments, the silicates do not form sharp x-ray reflexes such as those typical of crystalline substances, but instead have one or more maximums of the scattered x-ray radiation which have a width of several degree units of the diffraction angle. However, it may indeed lead to especially good builder properties if the silicate particles have blurred or even sharp diffraction maximums in the electron diffraction experiments. This is to be interpreted as meaning that the products have microcrystalline regions from 10 nm to a few hundred nm in size, values up to max. 50 nm and in particular up to max. 20 nm being preferred. Compacted/compressed amorphous silicates, compounded amorphous silicates and overdried x-ray amorphous silicates are preferred in particular.

The fine crystalline synthetic zeolite containing bound water that is used is preferably zeolite A and/or P. Zeolite MAP® (commercial product of the company Crosfield) is especially preferred as zeolite P. However, zeolite X and mixtures of Z, X and/or P are also suitable. For example, a co-crystal product of zeolite X and zeolite A (approx. 80 wt % zeolite X) distributed by the company SASOL under the brand name VEGOBOND AX® is commercially available and is also preferably usable within the scope of the present invention; this product can be described by the formula $$n\mathrm{Na_2O}.(1-n)\mathrm{K_2O}.\mathrm{Al_2O_3}.(2\text{-}2.5)\mathrm{SiO_2}.(3.5\text{-}5.5)\mathrm{H_2O}$$

n=0.90-1.0

The zeolite may be used as spray-dried powder or as an undried stabilized suspension which is still moist before use. For the case when the zeolite is used as a suspension, it may contain small additives of nonionic surfactants as stabilizers, e.g., 1 wt % to 3 wt %, based on zeolite, of ethoxylated $C_{12}$-$C_{18}$ fatty alcohols with 2 to 5 ethylene oxide groups, $C_{12}$-$C_{14}$ fatty alcohols with 4 to 5 ethylene oxide groups or ethoxylated istridecanols. Suitable zeolites have an average particle size of less than 10 μm (volume distribution; measurement method: Coulter counter) and preferably contain 18 wt % to 22 wt %, in particular 20 to 22 wt % bound water.

Of course the use of the generally known phosphates as builder substances is also possible if such a use should not be avoided for ecological reasons. In particular the sodium salts of the orthophosphates, the pyrophosphates and in particular the tripolyphosphates are suitable.

Organic builders which may be present in the detergent or cleaning agent include polycarboxylate polymers, such as polyacrylates and acrylic acid/maleic acid copolymers, polyaspartates and monomeric polycarboxylates such as citrates, gluconates, succinates or malonates which are preferably used as sodium salts.

Of the compounds that may be used as bleaching agents and supply $H_2O_2$ in water, sodium perborate tetrahydrate and sodium perborate monohydrate are especially important. Other usable bleaching agents include, for example, sodium percarbonate, peroxypyrophosphates, citrate perhydrates and peracid salts or peracids that yield $H_2O_2$ such as perbenzoates, peroxophthalates, diperazelaic acid, phthaloimino peracid or diperdodecane-dioic acid.

To achieve an improved bleaching effect in washing at temperature of 60° C. or below, bleach activators may also be incorporated into the detergents or cleaning agents. Bleach activators that may be used include compounds that yield under perhydrolysis conditions aliphatic peroxocarboxylic acids with preferably 1 to 10 carbon atoms, in particular 2 to 4 carbon atoms and/or optionally substituted perbenzoic acid. Substances having O- and/or N-acyl groups of the aforementioned number of carbon atoms and/or optionally substituted benzoyl groups are suitable. Polyacylated alkylenediamines in particular tetraacetylethylenediamine (TAED), acylated triazine derivatives in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenol sulfonates in particular n-nonanoyl or isononanoyloxybenzenesulfonate (n- and/or iso-NOBS), carboxylic acid anhydrides, in particular phthalic acid anhydride, acylated polyvalent alcohols, in particular triacetin, ethylene glycol diacetate and 2,5-diacetoxy-2,5-dihydrofuran are preferred.

In addition to or instead of the conventional bleach activators, so-called bleach catalysts may also be incorporated into the detergents or cleaning agents. These substances are bleach potentiating transition metal salts and/or transition metal complexes, such as Mn, Fe, Co, Ru or Mo saline complexes or carbonyl complexes. Mn, Fe, Co, Ru, Mo, Ti, V and Cu complexes with tripod ligands containing nitrogen as well as Co, Fe, Cu and Ru ammine complexes may also be used as bleach catalysts.

The detergent or cleaning agent may contain enzymes in encapsulated form and/or directly in the detergent or cleaning agent. The enzymes may include in particular those from the classes of hydrolases such as proteases, esterases, lipases and/or lipolytically acting enzymes, amylases, cellulases and/or other glycosyl hydrolases, hemicellulases, cutinases, β-glucanases, oxidases, peroxidases, mannanases, perhydrolases and/or laccases and mixtures of the aforementioned enzymes. All these hydrolases in the laundry contribute toward removal of spots such as spots containing protein, fat or starch and graying. Cellulases and other glycosyl hydrolases may also contribute toward the removal of pilling and microfibrils to preserve the color and increase the softness of the textile. Oxyreductases may also contribute toward bleaching and/or toward inhibiting the dye transfer. Enzymatic active ingredients obtained from bacterial strains or fungi such as *Bacillus subtilis, Bacillus licheniformis, Streptomyces griseus* and *Humicola insolens* are especially suitable. Proteases of the subtilisin type and in particular proteases obtained from *Bacillus lentus* are preferred for use here. Enzyme mixtures, e.g., of proteases and amylase or protease and/or lipolytically acting enzymes or protease and/or cellulase or from cellulase and lipase and/or lipolytically acting enzymes or from proteases, amylase and lipase and/or lipolytically acting enzymes or protease, lipase and/or lipolytically acting enzymes and cellulase, but in particular protease and/or lipase-containing mixtures and/or mixtures with lipolytically acting enzymes are of particular interest. Examples of such lipolytically acting enzymes include the known cutinases. Peroxidases or oxidases have also proven suitable in some cases. The suitable amylases include in particular α-amylases, isoamylases, pullulanases and pectinases. Preferably cellobiohydrolases, endoglucanases and β-glucosidases which are also known as cellobiases and/or mixtures of these are also used as cellulases. Since the various types of cellulases differ in their CMCase and avicelase activities, the desired activities may be established through targeted mixtures of the cellulases.

The enzymes may be adsorbed on carrier substances to protect them from premature degradation. The amount of enzymes or enzyme granules directly in the detergents or cleaning agents may be, for example, approx. 0.01 wt % to 5 wt %, preferably 0.12 wt % to 2.5 wt %.

However, it may also be preferable for the detergent or cleaning agent not to contain any enzymes, e.g., in the case of special detergents or cleaning agents for consumers with allergies and/or sensitive skin.

In one embodiment, the detergent or cleaning agent optionally contains one or more perfumes in an amount of usually up to 10 wt %, preferably 0.5 wt % to 7 wt %, in particular 1 wt % to 3 wt %, if necessary. The amount of perfume used also depends on the type of detergent or cleaning agent. However, it is preferable in particular for the perfume to be introduced into the detergent or cleaning agent through the textile-softening composition. However, it is also possible for the detergent or cleaning agent to contain perfume which is not introduced into the detergent or cleaning agent through the textile-softening composition.

To improve the aesthetic impression of the detergents or cleaning agents, they may be colored with suitable dyes (optionally also only partially). Preferred dyes, the selection of which does not present any problem for those skilled in the art, have a high stability in storage and are insensitive to the other ingredients of the detergents or cleaning agents and do not have a pronounced substantivity with respect to textile fibers so as not to stain them.

For example, soaps, paraffins or silicone oils which may optionally be applied to the carrier materials may be considered as foam inhibitors.

Suitable soil-release polymers, also known as "antiredeposition agents," include, for example, nonionic cellulose ethers such as methyl cellulose and methylhydroxypropyl cellulose with a methoxy group content of 15 wt % to 30 wt % and a hydroxypropyl group content of 1 wt % to 15 wt %, each based on the nonionic cellulose ethers and the polymers of phthalic acid and/or terephthalic acid known from the state of the art and/or their derivatives, in particular polymers of ethylene terephthalates and/or polyethylene and/or polypropylene glycol terephthalates or anionically and/or nonionically modified derivatives thereof. Suitable derivatives include the sulfonated derivatives of phthalic acid and terephthalic acid polymers. Another class of suitable soil-release polymers, in particular for textiles containing cotton, include modified polyamines, e.g., alkoxylated and/or quaternated and/or oxidized polyamines. The polyamines include, for example, polyalkyleneamines, e.g., polyethylene-amines or polyalkyleneimines such as polyethyleneimines. Preferred examples of this class of soil-release polymers include ethoxylated polyethyleneimines and ethoxylated polyethyleneamines.

Optical brighteners (so-called "whiteners") may also be added to the detergents or cleaning agents to eliminate graying and yellowing of the treated textile fabrics. These substances are absorbed onto the fibers and cause a brightening and simulated bleaching effect by converting invisible ultraviolet radiation into visible light of a longer wavelength, such that the ultraviolet light absorbed from sunlight is emitted as a faintly bluish fluorescence and yields pure white when combined with the yellow tone of the grayed and/or yellowed laundry. Suitable compounds are obtained, for example, from the substance class of 4,4'-diamino-2,2'-stilbenedisulfonic acids (flavonic acids), 4,4'-distyryl-biphenylene, methylumbelliferones, coumarins, dihydroquinolinones, 1,3-diarylpyrazolines, naphthalic acid imides, benzoxazole, benzisoxazole and benzimidazole systems as well as pyrene derivatives with heterocycle substituents. The optical brighteners are usually used in amounts between 0% and 0.3 wt %, based on the finished detergent or cleaning agent.

Graying inhibitors have the task of keeping the dirt released from the fiber suspended in the solution and thereby prevent reabsorption of dirt. To do so, water-soluble colloids, usually of an organic nature, are suitable, e.g., glue, gelatin, salts of ether sulfonic acids of starch or cellulose or salts of acidic sulfuric acid esters of cellulose or starch. Water-soluble polyamides containing acid groups are also suitable of this purpose. In addition, soluble starch preparations and other starch products than those mentioned above may also be used, e.g., degraded starch, aldehyde starches, etc. Polyvinylpyrrolidone may also be used. However, cellulose ethers such as carboxymethyl cellulose (Na salt), methyl cellulose, hydroxyalkyl cellulose and mixed ethers such as methylhydroxyethyl cellulose, methylhydroxypropyl cellulose, methylcarboxymethyl cellulose and mixtures thereof are preferably also used in amounts of 0.1 wt % to 5 wt %, based on the detergent or cleaning agent.

To effectively suppress the release of dyes and/or the transfer of dyes to other textiles during the washing and/or cleaning of dyed textiles, the detergent or cleaning agent may contain a dye-transfer inhibitor. It is preferable for the dye-transfer inhibitor to be a polymer or copolymer of cyclic amines such as vinylpyrrolidone and/or vinylimidazole. Polymers suitable as the dye-transfer inhibitor include polyvinylpyrrolidone (PVP), polyvinylimidazole (PVI), copolymers of vinylpyrrolidone and vinylimidazole (PVP/PVI), polyvinylpyridine N-oxide, poly-N-carboxymethyl-4-vinylpyridium chloride as well as mixtures thereof. Polyvinylpyrrolidone (PVP), polyvinylimidazole (PVI) or copolymers of vinylpyrrolidone and vinylimidazole (PVP/PVI) are especially preferably used as a dye-transfer inhibitor. The polyvinylpyrrolidones (PVP) used preferably have an average molecular weight of 2500 to 400,000 and are available commercially from ISP Chemicals as PVP K 15, PVP K 30, PVP K 60 or PVP K 90 or from BASF as Sokalan® HP 50 or Sokalan® HP 53. The copolymers of vinylpyrrolidone and vinylimidazole (PVP/PVI) that are used preferably have a molecular weight in the range of 5000 to 100,000. A PVP/PVI copolymer from BASF available under the brand name Sokalan® HP 56 is also available commercially.

The amount of dye-transfer inhibitor based on a total amount of detergent or cleaning agent is preferably 0.01 wt % to 2 wt %, especially 0.05 wt % to 1 wt % and more preferably from 0.1 wt % to 0.5 wt %.

Alternatively, however, enzymatic systems comprising a peroxidase and hydrogen peroxide and/or a substance that yields hydrogen peroxide in water may also be used as the dye-transfer inhibitor. Adding a mediator compound for the peroxidase, e.g., an acetosyringone, a phenol derivative or a phenothiazine or phenoxazine is preferable in this case, whereby the aforementioned polymeric dye-transfer inhibitors may also be used in addition.

Since textile fabrics, in particular those made of rayon, cellulose and mixtures thereof, may tend to crease, because the individual fibers are sensitive to bending, creasing, pressing and pinching across the direction of the fiber so the detergents or cleaning agents may contain synthetic crease-preventing agents. These include, for example, synthetic products based on fatty acid, fatty acid esters, fatty acid amides, fatty alkylol esters, alkylol amides or fatty alcohols, usually reacted with ethylene oxide, or products based on lecithin or modified phosphoric acid esters.

To combat microorganisms, the detergents or cleaning agents may contain antimicrobial active ingredients where a distinction is made between bacteriostatics and bactericides, fungistatics and fungicides, etc., depending on the antimicrobial spectrum and mechanism of action. Important substances from these groups include, for example, benzalkonium chlorides, alkylaryl sulfonates, halophenols and phenol mercuriacetate, but these compounds may also be omitted entirely from the inventive detergents or cleaning agents.

The inventive detergents or cleaning agents may contain preservatives, but preferably only those which have little or no skin sensitizing potential are used. Examples include sorbic acid and salts thereof, benzoic acid and salts thereof, salicylic acid and salts thereof, phenoxyethanol, 3-iodo-2-propynyl-butylcarbamate, sodium N-(hydroxymethyl) glycinate, biphenyl-2-ol and mixtures thereof. A suitable preservative is the solvent-free aqueous combination of diazolidinylurea, sodium benzoate and potassium sorbate (available as Euxyl® K 500 from Schuelke & Mayr) which may be used in a pH range up to 7.

The detergents or cleaning agents may contain antioxidants to prevent unwanted changes in the detergents or cleaning agents and/or the textile fabrics treated with them due to the effects of oxygen and other oxidative processes. This class of compounds includes, for example, substituted phenols, hydroquinones, pyrocatechols and aromatic amines as well as the organic sulfides, polysulfides dithiocarbamates, phosphites, phosphonates and vitamin E.

Increased wearability may result from the additional use of antistatic agents that are added to the detergents or cleaning agents. Antistatics increase the surface conductivity and thus allow an improved dissipation of the charges that are formed. External antistatics are usually substances with at least one hydrophilic molecular ligand and they form a more or less hygroscopic film on the surfaces. These antistatics, usually surface-active, can be subdivided into antistatics containing nitrogen (amines, amides, quaternary ammonium compounds), antistatics containing phosphorus (phosphoric acid esters) and antistatics containing sulfur (alkyl sulfonates, alkyl sulfates). Lauryl- (and/or stearyl)dimethylbenzylammonium chlorides are suitable as antistatics for textile fabrics and/or as additives to detergents or cleaning agents, and a finishing effect is also achieved.

To improve the rewettability of the treated textile fabric and to facilitate ironing of the treated textile fabric, silicone derivatives, for example, may be used in the detergents or cleaning agents. These additionally improve the rinse-out behavior of the detergents or cleaning agents through their foam-inhibiting properties. Preferred silicone derivatives include polydialkylsiloxanes or alkylarylsiloxanes, for example, in which the alkyl groups have one to five carbon atoms and are partially or entirely fluorinated. Preferred silicones include polydimethylsiloxanes, which may be derivatized, if necessary, and then are amino-functional or quaternated and/or have Si—OH, Si—H and/or Si—Cl bonds. The viscosity of the preferred silicones is in the range between 100 mPas and 100,000 mPas at 25° C., whereby the silicones may be used in amounts between 0.2 wt % and 5 wt %, based on the total detergent or cleaning agent.

Finally, the detergents or cleaning agents may also contain UV absorbers which are absorbed onto the treated textile fabric and improve the light fastness of the fibers. Compounds having these desired properties include, for example, the compounds and derivatives of benzophenone with substituents in positions 2 and 4, which are active through radiationless deactivation. In addition, substituted benzotriazoles, acrylates with a phenyl substituent in position 3 (cinnamic acid derivatives), optionally with cyano groups in position 2, salicylates, organic Ni complexes and natural substances such as umbelliferone and endogenous urocanic acid.

To avoid the heavy metal-catalyzed decomposition of certain detergent ingredients, substances that complex heavy metals may be used. Suitable heavy metal complexing agents include, for example, the alkali salts of ethylenediaminetetraacetic acid (EDTA) or of nitrilotriacetic acid (NTA) and alkali metal salts of anionic polyelectrolytes such as polymaleates and polysulfonates.

A preferred class of complexing agents are the phosphonates which are present in preferred detergents or cleaning agents in amount of 0.01 wt % to 2.5 wt %, preferably 0.02 wt % to 2 wt % and in particular 0.03 wt % to 1.5 wt %. These preferred compounds include in particular organophosphonates such as 1-hydroxyethane-1,1-diphosphonic acid (HEDP), aminotri(methylenephosphonic acid) (ATMP), diethylenetriaminepenta(methylenephosphonic acid) (DTPMP and/or DETPMP) and 2-phosphonobutane-1,2,4-tricarboxylic acid (PBS-AM), which are usually used in the form of their ammonium salts or alkali metal salts.

In addition, neutral filler salts such as sodium sulfate or sodium carbonate may also be present in the solid detergents or cleaning agents.

The inventive detergents or cleaning agent may be used in particular for cleaning and conditioning textile fabrics.

To produce the inventive detergents or cleaning agents, first the detergent or cleaning agent is produced without the textile care compound according to known methods which include, for example, drying steps, mixing steps, compacting steps, shaping steps and/or the subsequent addition of heat-sensitive ingredients ("post-addition"). Then the resulting product is mixed with a solid textile care composition. To produce detergents or cleaning agent tablets, additional compaction and/or shaping steps may follow the mixing step.

Table 1 shows the inventive textile care compositions E1 through E4.

TABLE 1

| | E1 | E2 | E3 | E4 |
|---|---|---|---|---|
| NaCl crystals (1-3 mm) | 69.99 | — | 60.99 | — |
| Sucrose crystals (1-4 mm) | — | 69.99 | — | 60.99 |
| Bentonite (powder) | 10 | 10 | 10 | 10 |
| Perfume | 5 | 5 | 5 | 5 |
| Polydimethylsiloxane | — | — | 6 | 6 |
| PEG 4000 | 15 | 1.5 | 15 | 15 |
| Dye | 0.01 | 0.01 | 0.01 | 0.01 |

The textile care compositions E1 were produced according to three alternative methods To produce the textile care composition E1 according to manufacturing method A, the polyethylene glycol with an average molecular weight of 4000 (PEG 4000) was melted and the perfume, the textile care clay and the dye were added to the melt. Then the colored melt was poured onto the NaCl crystals.

To produce the textile care composition E1 according to production method B, the NaCl crystals were mixed with the textile-softening clay. The polyethylene glycol with an average molecular weight of 4000 (PEG 4000) was melted and the perfume and the dye were added to the melt. Then the colored melt was poured onto the coated NaCl crystals.

To produce the textile care composition E1 according to production step C, the polyethylene glycol with an average molecular weight of 4000 (PEG 4000) was melted and the perfume and the dye were added to the melt. Then the colored melt was poured onto the NaCl crystals and the sheathed NaCl crystals were dusted with the bentonite powder.

The textile care compositions E2 through E4 were also produced each according to the three alternative production methods A through C.

The textile care compositions E1 through E4 had a very good dissolving behavior in contact with water, regardless of the production method, and had a softening effect with respect to textile fabrics treated with them in comparison with water. In addition, the textile care compositions E1 through E4 were capable of reducing the hardness of water. The determination was performed with test sticks for the "total hardness test" (Merck) according to the manufacturer's instructions and revealed that, for example, the hardness of the water used is reduced from 23 dH [German degrees of hardness] to 18° dH by adding the textile care composition.

For comparison of the scent intensity of a traditional liquid fabric softener (textile-softening diesterquat content: 15 wt %) with the solid textile care composition E2, produced according to production method C, terry cloth fabric on the one hand was treated on the one hand with only one solid commercially available detergent (comparison 1) and alternatively was treated with the same solid detergent and the traditional fabric softener (comparison 2) and then on the other hand was treated with the same detergent and the solid textile care composition E2 in a washing machine (Miele Novotronic W 985). After drying by hanging, the scent intensity was determined:

| Composition | Moist, freshly washed laundry | After 7 days on dry laundry |
|---|---|---|
| Comparison 1 | 1.3 | 1.4 |
| Comparison 2 | 2.4 | 1.7 |
| E2 | 3.1 | 1.7 |

Evaluation 0 = weak to 4 = great

Number of people performing evaluation: 7

The solid textile care composition E2 had a much higher scent intensity than a traditional fabric softener, in particular on moist, freshly washed laundry (comparison 2).

In addition, the inventive textile care compositions had a softening effect in comparison with water. After treatment and hang-drying, fabrics treated with water and/or with the textile care composition E2 (produced according to production method C) were handled and evaluated by a panel of five people (evaluation 0=hard to 5=very soft). Fabrics treated only with water received a value of 1.9, whereas fabrics treated with the textile care composition E2 had a value of 2.5.

To produce an inventive detergent or cleaning agent, a solid unperfumed detergent or cleaning agent was mixed with 10 wt % (based on the total amount of finished detergent or cleaning agent) of the textile care composition E2.

The inventive detergent or cleaning agent had good cleaning and conditioning properties.

No lime deposits were observed on the laundry and/or no deposit/residues were observed in the rinse dispenser compartment of the washing machines, either when the textile care compound was used separately or when it was added to a detergent or cleaning agent.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed or as needed to render such methods operative.

Changes in form and substitution of equivalents are contemplated as circumstances may suggest or render expedient. Although specific terms have been employed herein, such terms are intended in a descriptive sense and not for purposes of limitation.

What is claimed is:

1. A solid textile care composition, consisting of a water-soluble carrier particle, a water-soluble polymer, a textile care compound, a dye, and a perfume, wherein the water-soluble carrier particle:

a. is at least partially sheathed with a mixture consisting of a solidified melt of the water-soluble polymer, the textile care compound, the dye, and the perfume; or b. is coated with the textile care compound, and the coated water-soluble carrier particle has at least a partial sheathing consisting of a solidified melt of the water-soluble polymer, the dye, and the perfume; or c. has an at least partial sheathing consisting of a solidified melt of the water-soluble polymer, the dye, and the perfume, wherein the sheathing or the sheathing and the unsheathed areas of the carrier are at least partially coated with the textile care compound; and wherein the perfume consists of 1% to 20% by weight of the composition and the water-soluble polymer is a polyalkylene glycol.

2. The composition of claim 1, wherein the water-soluble carrier is an inorganic alkali metal salt, an organic alkali metal salt, an inorganic alkaline earth metal salt, an organic alkaline earth metal salt, an organic acid, a carbohydrate, a silicate, a urea, or a mixture thereof.

3. The composition of claim 1, consisting of 50 to 99 weight percent of the water-soluble carrier.

4. The composition of claim 3, consisting of 75 to 95 weight percent of the water-soluble carrier.

5. The composition of claim 1, wherein the textile care compound is a softening compound, a bleaching agent, a bleach activator, an enzyme, a silicone oil, an antiredeposition agent, an optical brightener, a graying inhibitor, a shrinkage inhibitor, a crease-preventing agent, a dye-transfer inhibitor, an antimicrobial active ingredient, a germicide, a fungicide, an antioxidant, an antistatic, an ironing aid, a phobicizing agent, an impregnation agent, a swelling agent, an anti-slip agent, a UV absorber, or a mixture thereof.

6. The composition of claim 5, wherein the textile-softening compound is a polysiloxane, a textile-softening clay, a cationic polymer, or a mixture thereof.

7. The composition of claim 1, wherein the water-soluble polymer has a melting point or softening point of 48° C. to 300° C.

8. The composition of claim 7, wherein the water-soluble polymer has a melting or softening point of 48° C. to 100° C.

9. The composition of claim 1, wherein the water-soluble polymer further comprises a polyvinyl alcohol.

10. The composition of claim 1, consisting of 1 to 10 weight percent of the perfume.

11. The composition of claim 10, consisting of 2 to 7 weight percent of the perfume.

12. The composition of claim 1, wherein the water-soluble carrier particles have a size of 0.6 to 30 millimeters.

13. The composition of claim 12, wherein the water-soluble carrier particles have a size of 1 to 3 millimeters.

14. A method of softening a textile fabric, comprising contacting a textile fabric in need of softening with a softening-effective amount of the composition of claim 5 in a main wash cycle of an automatic textile washing or cleaning process.

15. A solid textile care composition, consisting of a water-soluble carrier particle, a water-soluble polymer, a textile care compound, a dye, and a perfume, wherein the water-soluble carrier particle:

a. is at least partially sheathed with a mixture consisting of a solidified melt of the water-soluble polymer, the textile care compound, the dye, and the perfume; or b. is coated with the textile care compound, and the coated water-soluble carrier particle has at least a partial sheathing consisting of a solidified melt of the water-soluble polymer, the dye, and the perfume; or c. has an at least partial sheathing consisting of a solidified melt of the water-soluble polymer, the dye, and the perfume, wherein the sheathing or the sheathing and the unsheathed areas of the carrier are at least partially coated with the textile care compound, and wherein the perfume consists of 1% to 20% by weight of the composition, the water-soluble polymer is a polyalkylene glycol, the textile care compound consists of one or more textile-softening compounds selected from the group consisting of polysiloxanes, textile softening clays, cationic polymers, and mixtures thereof, and the water-soluble carrier particle has a particle size of 1 mm to 30 mm and consists of one or more compounds selected from the group consisting of inorganic alkali metal salts, organic alkali metal salts, inorganic alkaline earth metal salts, organic alkaline earth metal salts, organic acids, carbohydrates, silicates, urea, and mixtures thereof.

16. A solid textile-softening composition, consisting of a water-soluble carrier particle, a water-soluble polymer, a textile-softening compound, a dye, and a perfume, wherein the water-soluble carrier particle has an at least partial sheathing consisting of a solidified melt of the water-soluble polymer, the dye, and the perfume, wherein the sheathing or the sheathing and the unsheathed areas of the carrier are at least partially coated with the textile-softening compound, and wherein the composition consists of 1% to 20% by weight of the perfume.

17. The composition of claim 16 wherein the water soluble polymer is a polyalkylene glycol.

18. The composition of claim 16 wherein the textile-softening compound is a textile-softening clay.

19. The composition of claim 18, wherein the textile-softening clay is a bentonite.

20. The composition of claim 16 wherein the water-soluble carrier particle is a sugar.

* * * * *